US006623570B2

(12) United States Patent
Winkler et al.

(10) Patent No.: US 6,623,570 B2
(45) Date of Patent: Sep. 23, 2003

(54) ALMGSI CASTING ALLOY

(75) Inventors: Reinhard Winkler, Engen (DE); Gunter Höllrigl, Schaffhausen (CH); Jürgen Wuest, Erding (DE); Klaus Währisch, Essen (DE)

(73) Assignee: Alcan Technology & Management Ltd., Neuhausen am Rheinfall (CH)

( * ) Notice: Subject to any disclaimer, the term of this patent is extended or adjusted under 35 U.S.C. 154(b) by 56 days.

(21) Appl. No.: 10/072,448

(22) Filed: Feb. 8, 2002

(65) Prior Publication Data

US 2002/0155022 A1 Oct. 24, 2002

(30) Foreign Application Priority Data

Feb. 21, 2001 (EP) ..... 01810183

(51) Int. Cl.[7] ..... C22C 21/08; C22C 21/00

(52) U.S. Cl. ..... 148/415; 420/544; 420/546; 420/547; 420/549; 164/113; 164/900

(58) Field of Search ..... 148/415, 549; 420/542, 543, 546, 547, 544; 164/113, 900

(56) References Cited

U.S. PATENT DOCUMENTS 3,868,250 A * 2/1975 Zimmerman ..... 420/535

FOREIGN PATENT DOCUMENTS

EP 792380 B1 * 3/1999 ..... B22D/17/00
WO WO 00/43560 7/2000

OTHER PUBLICATIONS

Patent Abstracts of Japan Publication No. 05163546 entitled Die Casting Aluminum Alloy, by Tetsumura Tadayoshi, published Jun. 29, 1993.

* cited by examiner

*Primary Examiner*—George Wyszomierski
*Assistant Examiner*—Janelle Combs Morillo
(74) *Attorney, Agent, or Firm*—Bachman & LaPointe, P.C.

(57) ABSTRACT

A casting alloy of the AlMgSi type comprises

| | |
|---|---|
| Magnesium | 3.0 to 7.0 wt. % |
| Silicon | 1.7 to 3.0 wt. % |
| Manganese | 0.2 to 0.48 wt. % |
| Iron | 0.15 to 0.35 wt. % |
| Titanium as desired | max. 0.2 wt. % |
| Ni | 0.1 to 0.4 wt % |

and aluminum as the rest along with production related impurities, individually at most 0.02 wt. %, in total at most 0.2 wt. %, with the further provision that the magnesium and silicon are present in the alloy in a Mg:Si weight ratio of 1.7:1, corresponding to the composition of the quasi binary eutectic made up of the solid state phases Al and $Mg_2Si$, whereby the deviation from the exact composition of the quasi-binary eutectic amounts to at most −0.5 to +0.3 wt. % for magnesium and −0.3 to +0.5 wt. % for silicon the finely dispersed precipitates of the intermetallic phase $Mg_2Si$ results in high ductility. Good spherodisation of the $Mg_2Si$ precipitate particles takes place already at temperatures less than 400° C.

6 Claims, 1 Drawing Sheet

ALMGSI CASTING ALLOY

BACKGROUND OF THE INVENTION

The invention relates to a casting alloy of the AlMgSi type. Also within the scope of the invention is the use of the casting alloy for pressure diecasting, rheocasting and thixocasting, the use of the casting alloy for manufacturing large area and thin-walled components with a high capacity for absorbing kinetic energy by plastic deformation and the use of the casting alloy for manufacturing a component in the form of a safety element in automobile manufacture.

By using modern casting methods it is possible to produce components made of an aluminum alloy which can bear high loads. The aluminium alloys employed, however, must meet a number of requirements. One essential requirement defining the suitability of an alloy is the ability to satisfy specific mechanical properties. Certain minimum values of yield strength and tensile strength determine the load bearing capacity of a structure. In vehicle manufacture there is the further requirement that components that are bent as a result of collision should, prior to fracture, absorb as much energy as possible by plastic deformation—which calls for high ductility in the material selected. Under large series production conditions, it is possible to produce thin-walled castings in a cost favourable manner using pressure diecasting, rheocasting and thixocasting methods i.e. in a form for use as crash-relevant components in automobile manufacture. Thin walled parts place high demands on castability. Aluminum alloys able to provide the required flow behaviour or mould filling capacity are mainly those alloys with a eutectic containing silicon.

An AlMgSiMn alloy that is suitable for diecasting, rheocasting and thixocasting safety components for the automobile industry is known from EP-A-0 792 380. The alloy exhibits a magnesium excess compared with the composition corresponding to the quasi-binary eutectic. As a result of the high manganese content, sticking in the mould is avoided and the ease of removal from the mould is good. Apart from that, the alloy has a very low iron content.

Components with wall thicknesses that are in some cases small, such as those employed as structural parts in automobile manufacture, tend to distort on quenching with water and must, therefore, subsequently undergo complicated straightening operations. Also, residual gas porosity and a high solution treatment temperature can lead to blisters at the surface of the component. In the production of components of the kind mentioned above using pressure diecasting, rheocasting and thixocasting attempts are made, therefore, to meet the minimum strength and elongation values without high temperature solution treatment and subsequent water quenching.

For crash-relevant components in automobile manufacture the emphasis is placed on ductility i.e. formability and on ductile failure expressed by the elongation at fracture. The strength, expressed by the yield strength, can thereby be relatively low.

The object of the invention is to specify an aluminum alloy by means of which a high elongation at fracture can be reached with adequate yield strength, also without performing high temperature solution treatment and subsequent water quenching.

SUMMARY OF THE INVENTION

The foregoing object is achieved by way of the invention by providing a casting alloy of the AlMgSi type containing:

| | |
|---|---|
| Magnesium | 3.0 to 7.0 wt. % |
| Silicon | 1.7 to 3.0 wt. % |
| Manganese | 0.2 to 0.48 wt. % |
| Iron | 0.15 to 0.35 wt. % |
| Titanium as desired | max. 0.2 wt. % |
| Ni | 0.1 to 0.4 wt % |

and aluminum as the balance along with production related impurities, individually at most 0.02 wt. %, (weight-%) in total at most 0.2 wt. %, and with the further provision that the magnesium and silicon are present in the alloy in a Mg:Si weight ratio of 1.7:1, corresponding to the quasi binary eutectic made up of the phases Al and $Mg_2Si$, whereby the deviation from the exact composition of the quasi-binary eutectic amounts to at most −0.5 to +0.3 wt. % for magnesium and −0.3 to +0.5 wt. % for silicon.

BRIEF DESCRIPTION OF THE DRAWINGS

Further advantages, features and details of the invention are revealed in the following description of preferred exemplified embodiments and with the aid of the drawing which shows in simplified form in FIG. 1 the Mg:Si ratio in the alloy according to the invention, along with the tolerance limits.

DETAILED DESCRIPTION OF THE DRAWINGS

Figure 1:
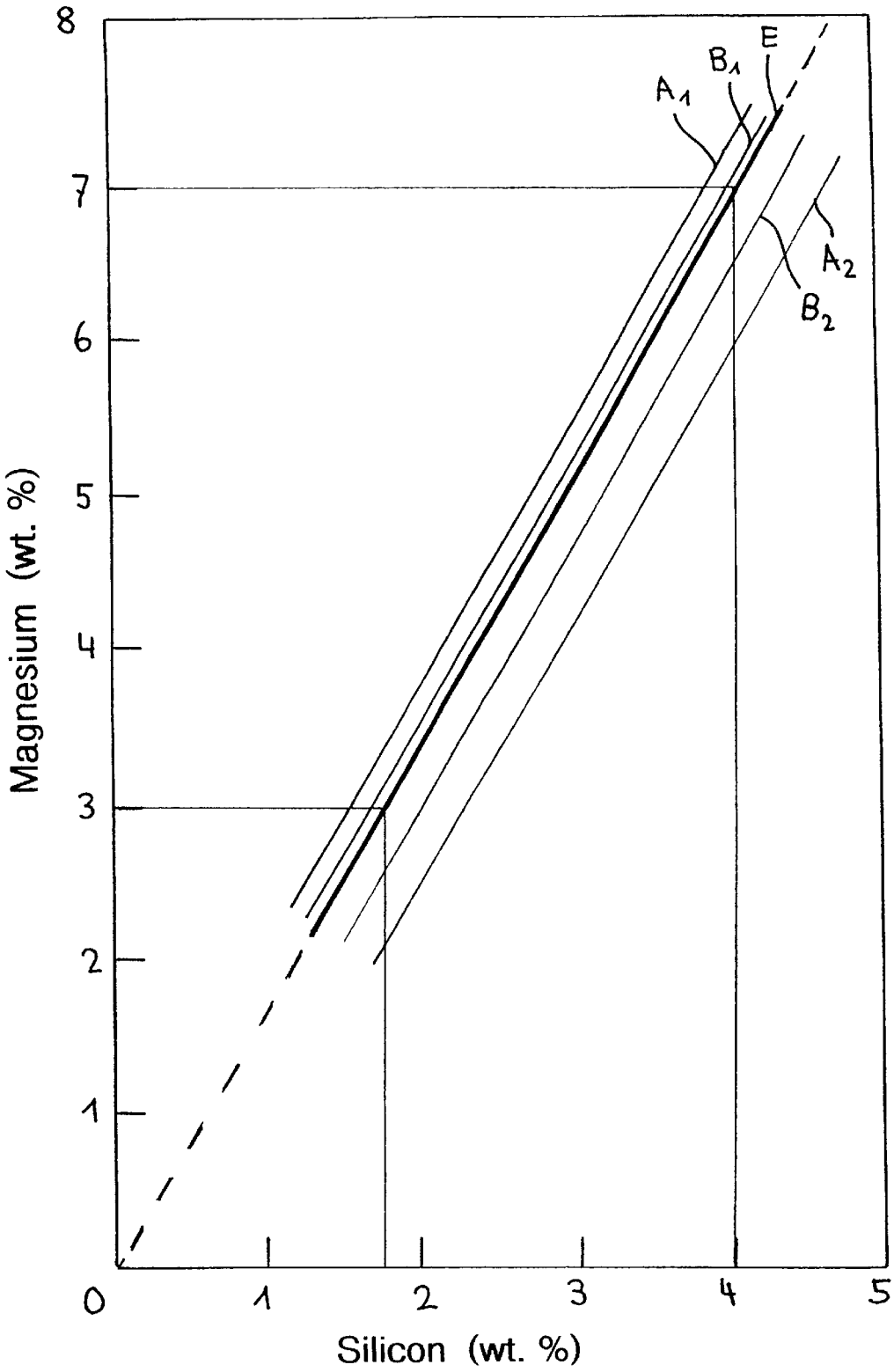

As a result of the selected, specific ratio of Mg:Si, the alloy according to the invention exhibits extremely favourable precipitation of the eutectic phase $Mg_2Si$ i.e. extremely finely and uniformly distributed, resulting in improved ductility with respect to comparable state-of-the-art alloys. Because of the higher iron content, it is possible to use aluminum of lower purity as its basis, thus reducing the production costs for the alloy. The higher iron content also makes it possible to reduce the amount of manganese added to the alloy to reduce the tendency to sticking to the diecasting mould. To achieve optimal mechanical properties care must be taken to ensure that the deviation from the exact composition for the quasi-binary eutectic amounts, at most, to −0.2 to +0.1 wt. % for magnesium and at most −0.1 to +0.2 wt. % for silicon.

In a casting alloy of optimal composition the concentrations of magnesium and silicon lie essentially in a weight ratio of Mg:Si of 1.7:1 corresponding to the composition of the quasi-binary eutectic.

The optional addition of 0.1 to 0.4 wt. % nickel leads to a further improvement in the ability to remove the part from the die i.e. reduction in sticking behaviour, as a result of which the manganese content in the alloy can be kept to the lower limit.

The higher iron and if desired nickel content in comparison with the alloy previously known from EP-A-0 792 380 has a positive influence on the mechanical properties as the $Al_{12}(Mn,Fe)_3Si$ phases occurring in this alloy are notably finer and more uniformly distributed in the structure.

Using the alloy according to the invention it is possible to meet all the requirements concerning strength and ductility of a safety part in automobile manufacture, this after performing the following three types of heat treatment viz., A, B and C:

Type A: As cast condition, moderate strength and good ductility, no heat treatment necessary Type B: Highest strength and moderate ductility, two heat treatments necessary Type C: Moderate strength and highest ductility, one heat treatment necessary.

A heat treatment of type A leads to a yield strength $Rp_{0.2}$ of up to 180 MPa and an elongation at fracture A5 of up to 13%. These strength and elongation properties can not be achieved with the normal diecasting, rheocasting and thixocasting alloys in the as-cast condition, i.e. without heat treatment.

With a type B heat treatment i.e. with solution treatment and precipitation hardening, strength values expressed as the yield strength Rp0.2 of up to 380 MPa can be reached, which is not possible with commercially available diecasting, rheocasting or thixocasting alloys.

With a type C heat treatment involving a solution heat treatment at 380–460° C. followed by air cooling it is possible to dispense with an artificial age-hardening heat treatment. As a result of the finely dispersed precipitation of the $Mg_2Si$ phase, ductility, or rounding off of the precipitates, is achieved already at a treatment temperature of less than 400° C. In the case of a type C heat treatment condition the alloy according to the invention is therefore a preferred version for components that have to meet the high demands related to crash behaviour. Apart from the fact that that components solution treated at a temperature below 400° C. and cooled in still air exhibit little distortion, the formation of gas-related blisters can be avoided by this heat treatment as a result of the relatively low temperature.

A eutectic-spherodising anneal at temperatures around 500° C.—currently normal in connection with diecasting, rheocasting and thixocasting alloys of the AlSi type—can be omitted to achieve the properties necessary for crash-relevant components.

As already mentioned, the alloy according to the invention is preferably employed for diecasting, rheocasting and thixocasting.

The preferred field of application for the alloy according to the invention is the production of large area, thin walled components having a large capacity for absorbing kinetic energy by plastic deformation. These properties correspond with the requirements made of safety components in automobile manufacture—for which reason the alloy is particularly suitable for manufacturing the above mentioned safety components.

Shown by line E in FIG. 1 is the optimal Mg:Si weight ratio of 1.7:1 corresponding to the composition of the quasi-binary Al/$Mg_2Si$ eutectic, whereby the region of interest here is 3.0 to 7.0 wt. % for the magnesium content and 1.7 to 3.0 wt. % for the silicon content. The maximum tolerable limits for magnesium and silicon are defined by the two straight lines A1 and A2, the preferred tolerance limits are indicated by the straight lines B1 and B2, whereby A1 and B1, with reference to the eutectic composition of the phases A1 and $Mg_2Si$, lie on the magnesium excess side and A2 and B2 lie on the silicon excess side. The casting alloy according to the invention has its larger tolerance region on the silicon excess side.

EXAMPLES

A cast part with a wall thickness of 2.5 mm was produced on a diecasting machine using an alloy of the following composition (wt. %)

| Mg | Si | Mn | Ni | Fe | Ti |
|---|---|---|---|---|---|
| 3.25 | 1.91 | 0.25 | 0.19 | 0.19 | 0.08 |

and aluminum as the rest along with impurities resulting from the manufacturing process individually at most 0.02 wt. %, in total at most 0.2 wt. %. Tensile test pieces were prepared from the casting and the mechanical properties of these determined after subjecting them to heat treatments according to the types A, B and C. The following heat treatments were carried out:

Type A: As-cast, no heat treatment

Type B: Solution treatment for 3h at 540° C., quenched in water, precipitation hardening for 8h at 170° C.

Type C: 50 minutes heat treatment at 390° C., followed by cooling in still air.

The results are summarised in the following table where Rp0.2 represents the yield strength, Rm the tensile strength at failure and A5 the elongation at failure. The values represent the average values from five test pieces.

| Heat treatment | Rp0.2 (MPa) | Rm (MPa) | A5 (%) |
|---|---|---|---|
| Type A | 186.2 | 324.6 | 12.0 |
| Type B | 355.8 | 430.2 | 4.1 |
| Type C | 110.3 | 240.2 | 16.5 |

What is claimed is:

1. Casting alloy of the AlMgSi type, comprising:

| | |
|---|---|
| Magnesium | 3.0 to 7.0 wt. % |
| Silicon | 1.7 to 3.0 wt. % |
| Manganese | 0.2 to 0.48 wt. % |
| Iron | 0.15 to 0.35 wt. % |
| Titanium | up to 0.2 wt. % max. as desired |
| Ni | 0.1 to 0.4 wt % |

and balance aluminum and production related impurities, individually at most 0.02 wt. % and, in total at most 0.2 wt. %, wherein the magnesium and silicon are present in the alloy in a Mg:Si weight ratio of 1.7:1, corresponding to the composition of the quasi binary eutectic made up of the solid state phases Al and $Mg_2Si$, whereby the deviation from the exact composition of the quasi-binary eutectic amounts to at most −0.5 to +0.3 wt. % for magnesium and −0.3 to +0.5 wt. % for silicon.

2. Casting alloy according to claim 1, wherein the deviation from the exact composition for the quasi-binary eutectic amounts, at most, to −0.2 to +0.1 wt. % for magnesium and at most −0.1 to +0.2 wt. % for silicon.

3. Casting alloy according to claim 1, wherein the concentrations of magnesium and silicon lie essentially in a Mg:Si weight ratio of 1.7:1 corresponding to the composition of the quasi-binary eutectic.

4. A process comprising casting the casting alloy according to claim 1 by one of diecasting, rheocasting and thixocasting.

5. A process comprising casting the casting alloy according to claim 1 to produce a large area and thin walled component having a high capacity for absorbing kinetic energy by plastic deformation.

6. A process comprising casting the casting alloy according to claim 1 to produce a safety component for a vehicle.

* * * * *